US006749316B1

(12) United States Patent
Wong et al.

(10) Patent No.: US 6,749,316 B1
(45) Date of Patent: Jun. 15, 2004

(54) SIDE ARM BATON WITH FLASHLIGHT AND CAMERA

(76) Inventors: Bruce Wong, 297 Mosel Ave., Staten Island, NY (US) 10304; Gregory V Glover, 24 Prospect Ave., Staten Island, NY (US) 10301

( * ) Notice: Subject to any disclaimer, the term of this patent is extended or adjusted under 35 U.S.C. 154(b) by 79 days.

(21) Appl. No.: 10/376,028

(22) Filed: Feb. 28, 2003

(51) Int. Cl.[7] ..... A45B 3/02

(52) U.S. Cl. ..... 362/102; 396/429; 348/552; 362/109

(58) Field of Search ..... 362/102, 109, 362/119, 120, 253; 369/429; 348/372, 373, 376, 151, 552

(56) References Cited

U.S. PATENT DOCUMENTS 4,479,171 A 10/1984 Mains ..... 362/102
5,060,123 A * 10/1991 Arnold ..... 362/102
5,197,734 A 3/1993 Ashihara ..... 273/84
5,347,436 A 9/1994 Clyde et al. ..... 362/102
5,363,285 A * 11/1994 Wideman ..... 362/102
6,386,726 B1 * 5/2002 Macierowski et al. ..... 362/102
6,499,855 B1 * 12/2002 Kukuk ..... 362/102

* cited by examiner

*Primary Examiner*—Laura K. Tso
(74) *Attorney, Agent, or Firm*—Goldstein Law Offices, P.C.

(57) ABSTRACT

A side arm baton with flashlight and camera, for protection of a user from an assailant, having a cylindrical stick portion having a first and a second end, and a cylindrical handle portion extending perpendicular to the stick portion at a distance along the stick portion which is closer to the second end than to the first end. The device has a flashlight having a bulb located at the first end of the stick portion, and a camera mechanism. The buttons which activate the camera and the flashlight and the camera lens are located on the surface of the handle portion which is oriented toward the first end of the stick portion.

7 Claims, 3 Drawing Sheets

SIDE ARM BATON WITH FLASHLIGHT AND CAMERA

BACKGROUND OF THE INVENTION

1. Field of the Invention

The invention relates to a combination side-handled baton and flashlight which may be used by law enforcement officers or private citizens for protection, lighting and documenting any altercations. The baton portion may be used for blocking an assailant's attack or to keep him/her at a safe distance from the user. Additionally, the flashlight mechanism provides the user with light so that the assailant may be easily seen even under low ambient light conditions. Optionally, a camera mechanism may be included within the device, for photographing the assailant. This device also allows one hand to be free, and reduces the amount of equipment an officer or private citizen may have to carry.

2. Description of the Related Art

Police officers and others who work in law enforcement often need to work under conditions with very poor lighting. These conditions may occur outdoors after the sun has set, or may occur indoors in areas that are either poorly lit or without lighting at all. Under these conditions, it is even more dangerous than usual for an officer or other worker to confront an assailant. This instrument may also be used successfully as a diversion device.

Accordingly, there is a need for a baton which is equipped with a battery-operated flashlight, so that an officer may see his/her assailant merely by turning on the flashlight which comprises part of the baton.

Others have attempted to combine side arm batons and flashlights in various configurations in attempts to provide law enforcement officers additional protection. U.S. Pat. No. 5,347,436 to Clyde et al appears to show a combined flashlight/baton with a stick portion and a handle which is orthogonal to the stick portion. However, Clyde contemplates positioning the orthogonal handle midway between the ends of the stick portion. Accordingly, Clyde does not provide for the greatest amount of separation of the user from the would-be assailant. Furthermore, Clyde does not contemplate the additional feature of a camera within the device and is useless for making a permanent record of the transaction in question.

U.S. Pat. No. 4,479,171 to Mains appears to show a side arm baton and flashlight. However, Mains contemplates placement of the light bulb and reflector within the short end of the baton, and therefore does not allow the user to maintain a suitable distance from a would-be assailant. Furthermore, Mains does not contemplate the inclusion of a camera within the side arm baton and cannot make a record of events as they transpire.

U.S. Pat. No. 5,197,734 to Ashihara appears to show a longitudinal club with a crosshandle. However, Ashihara contemplates placement of the crosshandle midway between the ends of the stick portion, and therefore will not maximize the distance between the user and the assailant. Furthermore, although Ashihara contemplates addition of a flashlight and/or a gas ejecting device to the crosshandle or stick portion, it has no provision for recording an encounter with an assailant.

While these units may be suitable for the particular purpose employed, or for general use, they would not be as suitable for the purposes of the present invention as disclosed hereafter.

SUMMARY OF THE INVENTION

It is an object of the invention to produce a device which has both a nightstick which may be used for protection against an assailant, and also a handle portion by which the device may be securely grasped. Accordingly, this device is comprised of a longitudinal nightstick portion and a handle portion which is attached to the nightstick portion at a position along the length of the nightstick where it may be easily grasped.

It is another object of the invention to provide a device which has a flashlight located within the nightstick portion, so that a user can shine light upon a would-be assailant while at the same time keeping the assailant at a distance which provides some measure of safety to the user. Accordingly, this device has a flashlight located within its stick portion, which may be used to shine light upon a would-be assailant while the nightstick portion keeps the would-be assailant at a safe distance from the user.

It is yet another object of the invention to provide a device wherein the longer end of the stick portion is typically located in front of the user when the device is being grasped by its handle portion, in order to maximize the distance between the user and an assailant. Accordingly, this device has a handle portion which is located at a point on the nightstick which is at a substantial distance from the front of the device, and therefore the longer end of the stick portion is located in front of the user, thereby maximizing the distance between the user and the assailant.

It is a further object of the invention to provide a device that is not unduly expensive. Accordingly, the structural components of this device may be constructed from inexpensive materials such as metal, rubber, or hard plastic. Additionally, the flashlight which is integral to this device may be constructed from simple, inexpensive components.

It is a still further object of the invention to optionally provide a device which allows a user to record any encounters with an assailant. Accordingly, the device is optionally equipped with a camera, with the camera lens located on the handle portion, and which may be selectively activated by a button located upon the handle portion, so that any encounters can be recorded.

It is an additional object of the invention to furnish a device which is also useful for protecting utility workers, homeowners, and campers. Accordingly, the device requires minimal training prior to its use, and is easily operable even by individuals without a law enforcement background.

It is still another object of the invention to furnish a device which allows a user to shine light upon an assailant, record encounters with an assailant, and ward off an assailant, by the use of a single arm and hand, thereby allowing the other arm of the user to be used for other purposes. Accordingly, this device is a protective instrument which may be grasped with only one hand, and the flashlight and the camera may also be activated by pressing buttons with the same hand, thereby allowing the other arm of the user to be used for other purposes.

It is yet another object of the invention to furnish a device where the buttons used for activating the camera and the flashlight are located at a position where they may be easily reached during a confrontation. Accordingly, the buttons which enable the camera and the flashlight are conveniently located on the front surface of the handle portion, where they may be easily reached by the user.

The invention is a side arm baton with flashlight and camera, for protection of a user from an assailant, having a cylindrical stick portion having a first and a second end, and a cylindrical handle portion extending perpendicular to the stick portion at a distance along the stick portion which is closer to the second end than to the first end. The device has a flashlight having a bulb located at the first end of the stick portion, and a camera mechanism. The buttons which activate the camera and the flashlight and the camera lens are located on the surface of the handle portion which is oriented toward the first end of the stick portion.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
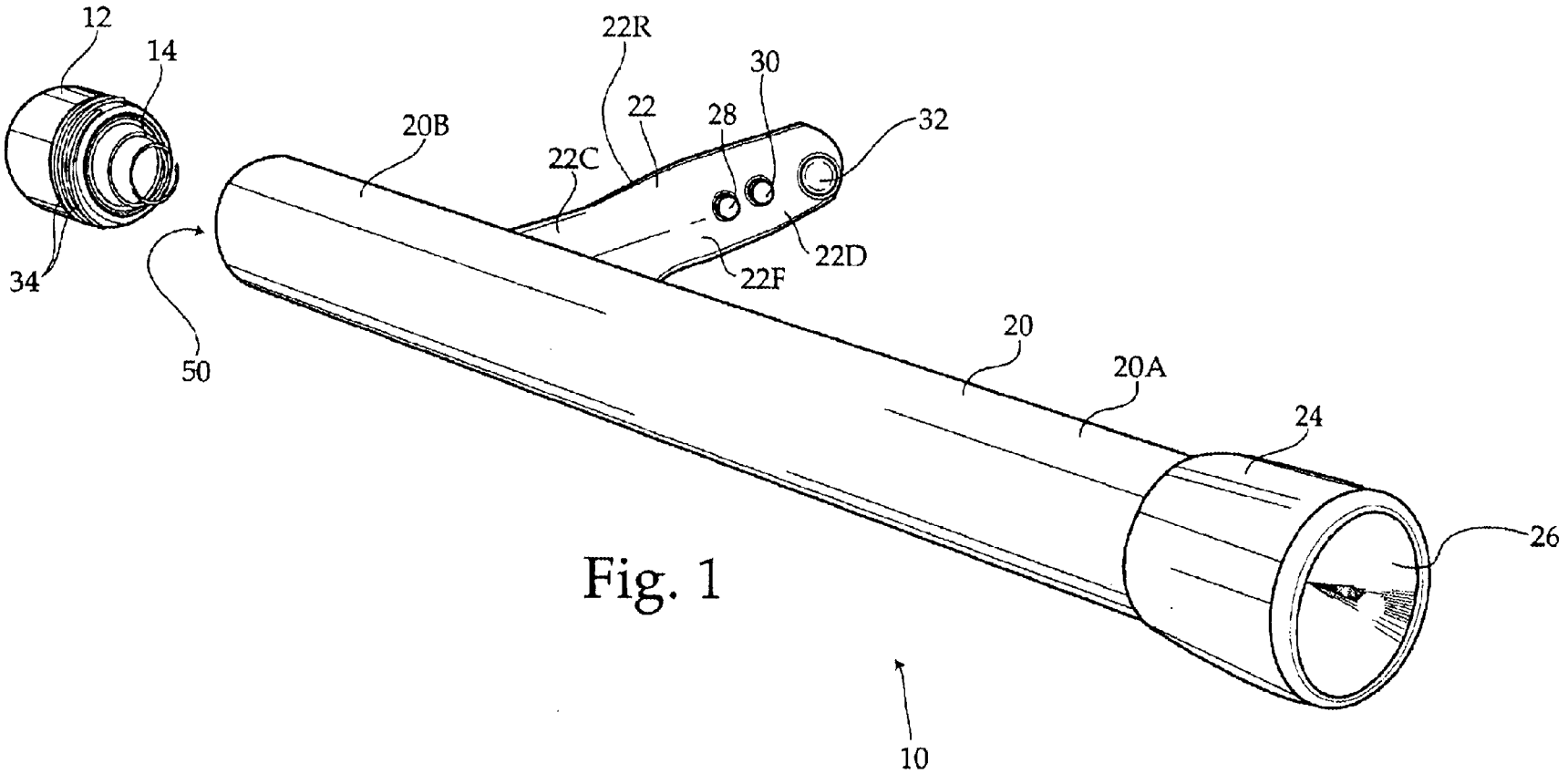
FIG. 1 is a perspective view of the side arm baton with flashlight and camera.
Figure 2:
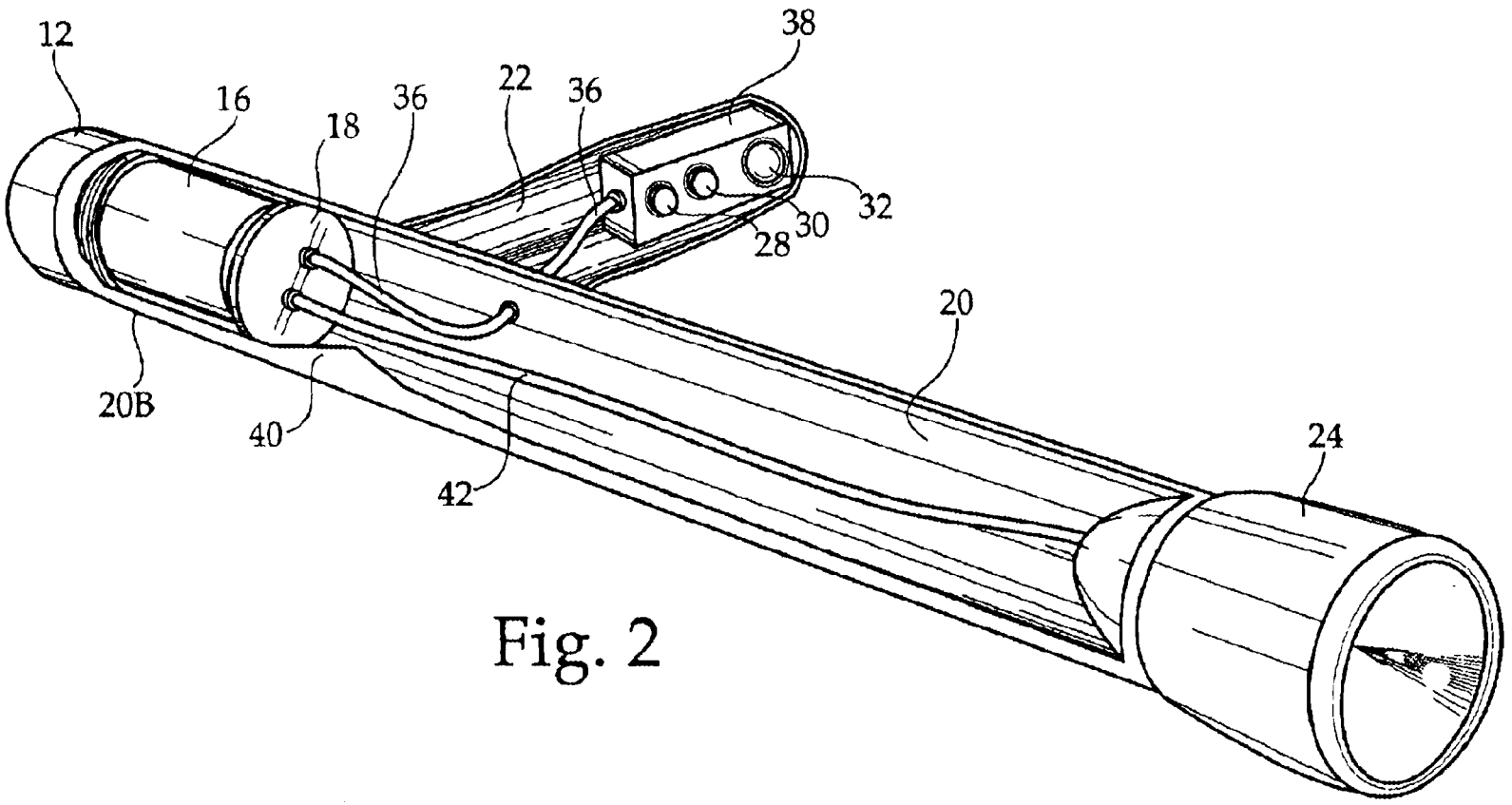
FIG 2 is a perspective view of the device with portions of the housing broken away to reveal components contained within the stick portion and the handle portion.

FIG. 1 is a perspective view illustrating a baton 10, having a housing 40 which includes a substantially cylindrical stick portion 20, and a substantially cylindrical handle portion 22 which is orthogonal to and extends from the stick portion 20. The stick portion 20 has a first end 20A and a second end 20B. The device 10 further comprises a camera having a lens 32 and a camera button 28. The camera is preferably located within the handle portion 22. The camera is preferably a battery operated digital camera. The baton 10 further comprises a flashlight having a flashlight bulb housing 24 located at the first end 20A of the stick portion 20. The flashlight has a flashlight button 30 which is located on the handle:portion 22. The baton 10 has a battery compartment 50 for housing one or more batteries 16, and a battery cap 12 which are located at the second end 20B of the stick portion 20. The handle portion 22 extends perpendicular to the stick portion 20 at a distance along the stick portion 20 which is closer to the second end 20B than to the first end 20A. This positioning of the handle portion 22 at a substantial distance from the flashlight bulb housing 24 allows a user to illuminate an assailant with the first end 20A while keeping as far away from the assailant as possible. Turning momentarily to FIG. 2, the second end 20B of the stick portion 20 is seen to have a battery plate 18, constructed at least partially of electrically conductive material, located in proximity to the battery cap 12. In FIG. 1, the battery cap 12, which has an attached coil 14, has been removed in order to show the coil 14 which ensures that the battery 16 maintains contact with electrically conductive material on the battery plate 18, in order to complete an electrical circuit with the flashlight bulb housing 24. The second end 20B of the stick portion 20 is internally threaded. The battery cap 12 also has external threads 34, which allows the battery cap 12 to be threaded snugly into the second end 20B of the stick portion 20. The flashlight bulb housing 24 has a transparent lens 26 which is constructed of an especially durable piece of glass or plastic, in order that it may withstand the forces that the device 10 may be subjected to while being used to ward off an assailant. The handle portion 22 has a first end 22C and a second end 22D. The handle portion 22 also has a front surface 22F and a rear surface 22R. The front surface 22F is oriented towards the first end 20A of the stick portion 20, and the rear surface 22R is oriented towards the second end 20B of the stick portion 20. The first end 22C of the handle portion 22 is firmly attached to the stick portion 20. The front surface 22F of the second end 22D of the handle portion 22 has the camera button 28 which selectively activates the camera, the flashlight button 30 which selectively activates the flashlight, and the camera lens 32.

FIG. 2 is a perspective view of the device 10 with portions of the housing 40 which encloses the stick portion 20 and the handle portion 22 broken away so that the electrical circuit and other components contained within the device may be seen. The stick portion 20 and the handle portion 22 are seen to contain wires 36 and 42 which comprise part of the flashlight bulb circuit. The battery plate 18 is positioned close to the second end 20B of the stick portion 20. When the battery 16 is placed inside the battery compartment 50 and the battery cap 12 is threaded snugly into the matching threads within the second end 20B of the stick portion 20, a tight fit results between the electrically conductive portions of the battery 16, the battery plate 18, and wires 36 and 42 which are in contact with the battery plate 18. A switch housing 38 is located inside the handle portion 22. The switch housing 38 has the flashlight button 30, the camera button 28, and the camera lens 32. Wire 36 extends from the switch housing 38 to the battery plate 18. Wire 42 extends from the battery plate 18 to the flashlight bulb housing 24, where it is in electrical contact with the flashlight bulb contained therein. If the baton 10 includes a metallic sleeve immediately inside the housing 40, such metallic sleeve may be connected to one terminal of the battery to complete the circuit with the flashlight bulb housing 24 and the camera. The circuit which supplies electricity to the flashlight bulb will be closed when the user depresses the flashlight button 30. The inside of the baton 10 may be hollow except for the battery plate 18, the battery 16, the wires 36 and 42, the camera, and the switch housing 38. Alternatively, the inside of the baton 10 may be constructed of sturdy and hefty material throughout. The increased mass which would result from filling these otherwise empty spaces would make the baton 10 more useful as both a defensive and an offensive weapon, and could conceivably function to protect the electrical components of the device 10 from the shock of repeated contacts with an assailant.

Figure 3:
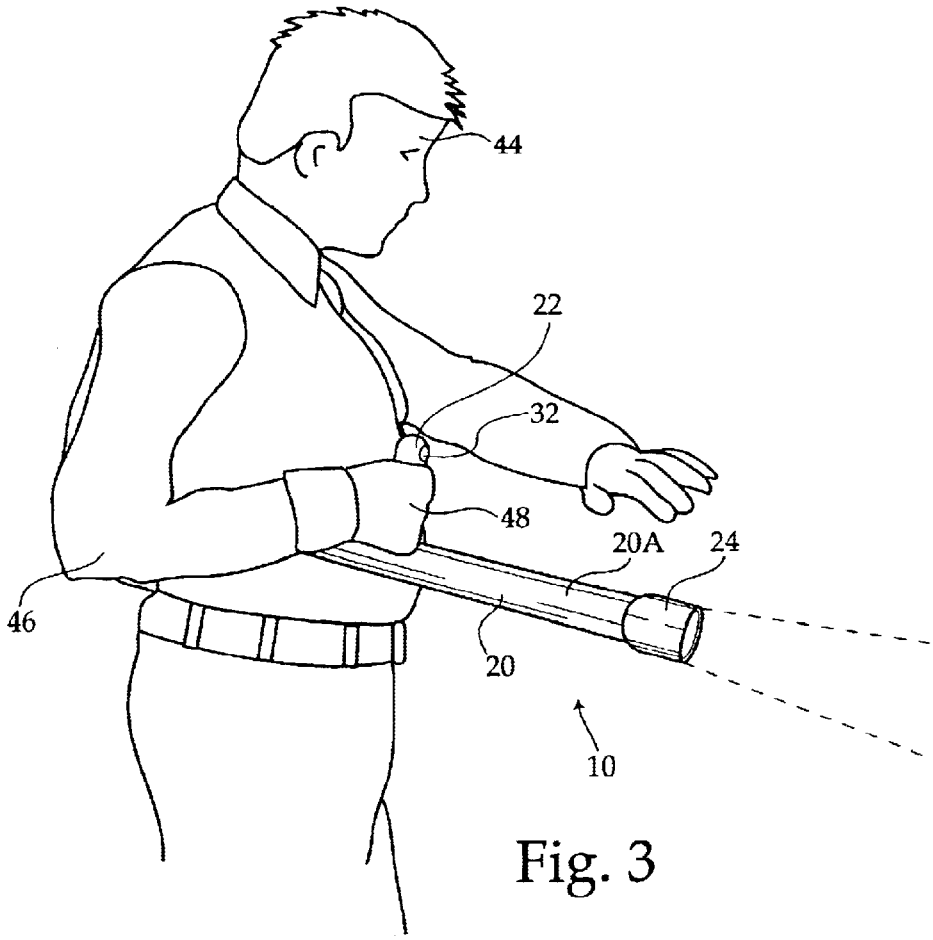
FIG. 3 is a perspective view of the device in use by a user who has activated the light and has positioned the device to be used as a protective instrument against an assailant.

FIG. 3 shows the device 10 as it might be employed by a user 44 having an arm 46 having a hand 48, to ward of an assailant. The hand 48 of the user 44 is firmly grasping the handle portion 22 of the device 10. The camera lens 32 is unobstructed by the hand 48, and is capable of recording images of an assailant. The first end 20A of the stick portion 20 which contains the flashlight bulb housing 24 extends in front of the user 44 and is oriented toward the assailant so that it may be used as either a protective instrument or to shine light upon an assailant for photo identity.

In use, the device 10 is typically carried in the hand 48 of the user 44 by the handle portion 22, with the first end 20A of the stick portion 20 pointing downward, until the user is confronted with a situation which requires the active use of the device 10. When confronted with such a situation, the user lifts his/her arm 46, all the while maintaining a firm grip on the handle portion 22, and points the first end 20A of the device 10 in the direction of the assailant. If ambient light conditions are poor, the user 44 depresses the flashlight button 30 and thereby activates the flashlight. If it is additionally desirable to maintain a record of the events which transpire, the camera button 28 is depressed, and the camera is thereby activated. The camera lens 32 which is located at the front surface 22F of the second end 22D of the handle portion 22 remains unobstructed throughout. The user 44 may illuminate the assailant and record his/her actions while butting the assailant with the first end 20A of the stick portion 20 and extending the stick portion 20 to maintain a safe distance between the user and the assailant. When the device is no longer immediately needed, the aforementioned buttons will be turned off and the device will again be carried with the first end 20A of the stick portion 20 pointing downward.

What is claimed is:

1. A side arm baton for protection of a user from an assailant, comprising:

a substantially cylindrical stick portion having a first end and a second end;

a substantially cylindrical handle portion extending perpendicular to the stick portion at a distance along the stick portion which is closer to the second end than to the first end, said handle portion having a front surface and a rear surface, the front surface oriented toward the first end of the stick portion, the rear surface oriented toward the second end of the stick portion; and a flashlight having a bulb located at the first end of the stick portion, and a flashlight button located on the front surface of the handle portion which a user may depress in order to enable the flashlight mechanism.

2. The side arm baton as recited in claim 1, further comprising a camera mechanism, said camera mechanism having a lens, and a camera button which activates the camera, said lens and said camera button being located on the front surface of the handle portion, in proximity to the flashlight button.

3. The side arm baton as recited in claim 2, further comprising a battery compartment for holding batteries for powering the flashlight, said battery compartment being located at the second end of the stick portion of the device.

4. The side arm baton as recited in claim 3, wherein the camera is a battery-operated digital camera.

5. The side arm baton as recited in claim 4, wherein the handle portion has two ends, one of which is connected to the stick portion, and the other end of which is a free end, wherein the flashlight button, the camera button, and the lens are located near the free end of the handle portion, so that they are easily reachable by a user.

6. A method for protecting a user having an arm having a hand, from an assailant, using a sidearm baton, having a stick portion and a handle portion, said stick portion having a first end and a second end, the handle portion extending substantially perpendicular to the stick portion closer to the second end than to the first end, the baton also having a flashlight having a bulb located at the first end of the stick portion and having a flashlight button located in proximity to the handle, comprising the steps of:

carrying the device by the user by holding the handle portion in the hand of the user;

pointing the first end of the stick portion at the assailant;

illuminating the assailant by depressing the flashlight button after determining by the user that ambient light conditions make lighting from the light bulb portion desirable; and thrusting the first end of the stick portion at the assailant to use the baton as a protective instrument against the assailant.

7. A method for protecting a user having an arm having a hand, from an assailant, using a sidearm baton, having a stick portion and a handle portion, said stick portion having a first end and a second end, the handle portion extending substantially perpendicular to the stick portion closer to the second end than to the first end, the handle portion also having a front surface oriented toward the first end of the stick and a rear surface oriented toward the second end of the stick, the baton also having a flashlight having a bulb located at the first end of the stick portion and having a flashlight button, the baton further having a camera having a lens and a button, wherein the flashlight button, the camera button, and the lens are located on the front surface of the handle, comprising the steps of:

carrying the device by the user by holding the handle portion in the hand of the user;

pointing the first end of the stick portion at the assailant;

depressing the flashlight button after determining that ambient light conditions make lighting from the light bulb portion desirable;

depressing the camera button by the user to record the assailant; and thrusting the stick portion at the assailant to use the baton as a weapon against the assailant.

* * * * *